United States Patent [19]

Ching

[11] Patent Number: 4,902,057

[45] Date of Patent: Feb. 20, 1990

[54] ADJUSTABLE DEADLATCH

[75] Inventor: Hui P. Ching, Mei Foo Sun Chuen, Hong Kong

[73] Assignee: Hing Wai Metal Factory Ltd., Kwai Chung, Hong Kong

[21] Appl. No.: 380,538

[22] Filed: Jul. 17, 1989

[51] Int. Cl.[4] ..... E05C 1/16

[52] U.S. Cl. ..... 292/337; 292/1; 292/DIG. 60; 292/DIG. 74; 70/461

[58] Field of Search ..... 292/1, 337, DIG. 74, 292/DIG. 60, 168, 169.21; 70/461

[56] References Cited

U.S. PATENT DOCUMENTS

| | | | |
|---|---|---|---|
| 4,372,594 | 2/1983 | Gater | 292/DIG. 60 X |
| 4,623,174 | 11/1986 | Trull et al. | 292/337 X |
| 4,708,379 | 11/1987 | Ching | 292/DIG. 60 X |
| 4,725,086 | 2/1988 | Shen | 292/DIG. 60 X |
| 4,759,576 | 7/1988 | Ching | 292/DIG. 60 X |
| 4,772,055 | 9/1988 | Fang | 292/DIG. 60 X |

*Primary Examiner*—Gary L. Smith
*Assistant Examiner*—Suzanne L. Dino
*Attorney, Agent, or Firm*—Charles H. Schwartz; Ellsworth R. Roston

[57] ABSTRACT

An adjustable deadlatch for a lockset for adjusting to either of two backset positions. First and second cylindrical members are located in a telescopic arrangement for allowing a longitudinal telescopic adjustment between the cylindrical members. First longitudinal adjustment structure is interconnected between the cylindrical members and includes a first vertical slot and a first pin member located within the first vertical slot and includes a first rotatable member supporting the first pin member at a radial position. A deadbolt, located within the first cylindrical member includes a longitudinal opening. An actuating member includes a longitudinal portion located within the longitudinal opening. Second longitudinal adjusting structure is coupled between the deadbolt and the actuating member and includes a second vertical slot and a second pin member received within the second vertical slot and mounted on a second rotatable member at a radial position. The adjustment structures are interconnected so that rotation of either provides for rotation of the other for coordinating the longitudinal adjustment between the cylindrical members and between the deadbolt and the actuating member and thereby provides for an adjustment corresponding to the two backset positions.

20 Claims, 4 Drawing Sheets

FIG. 1
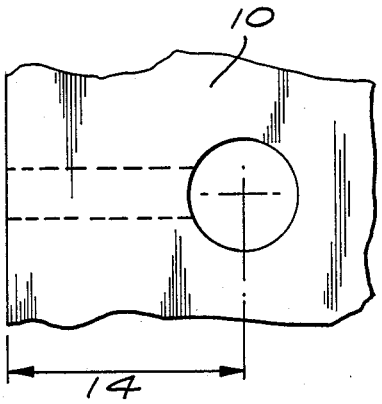
FIG. 2
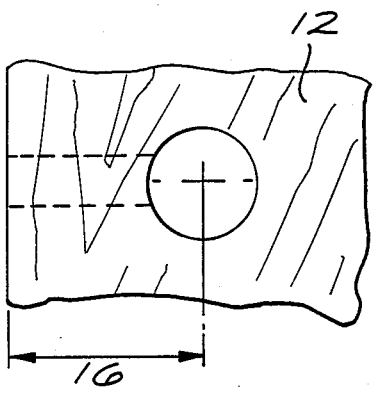
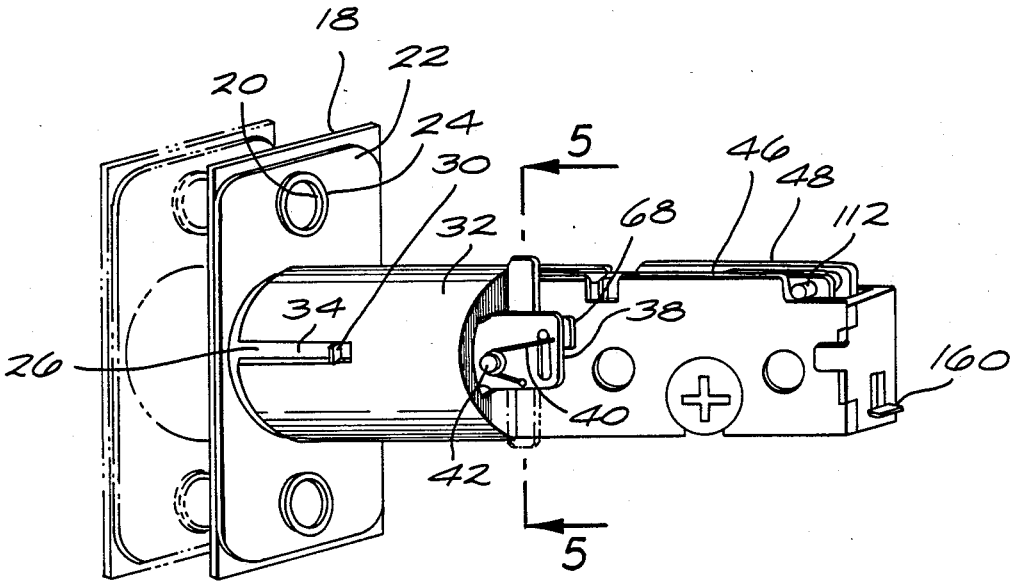
FIG. 3

FIG. 5
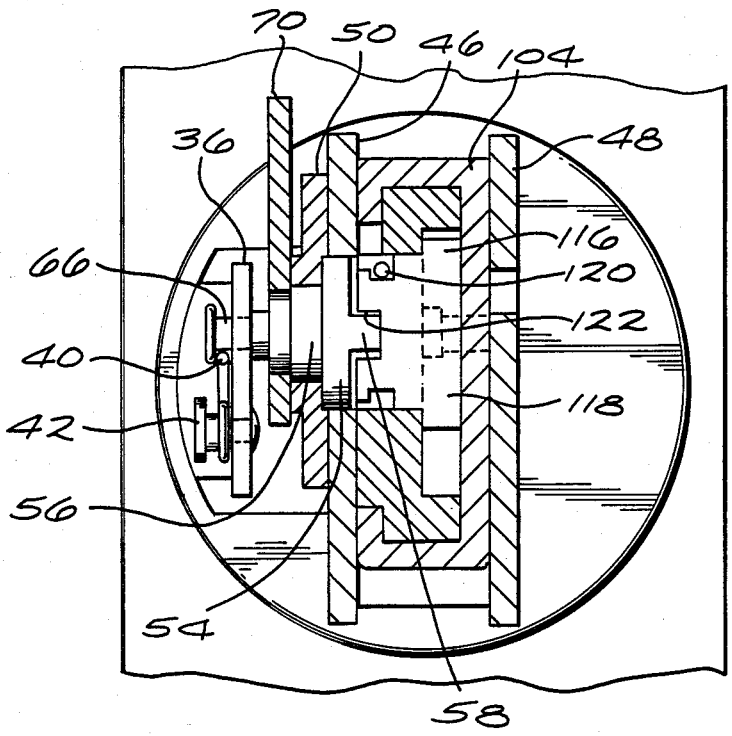
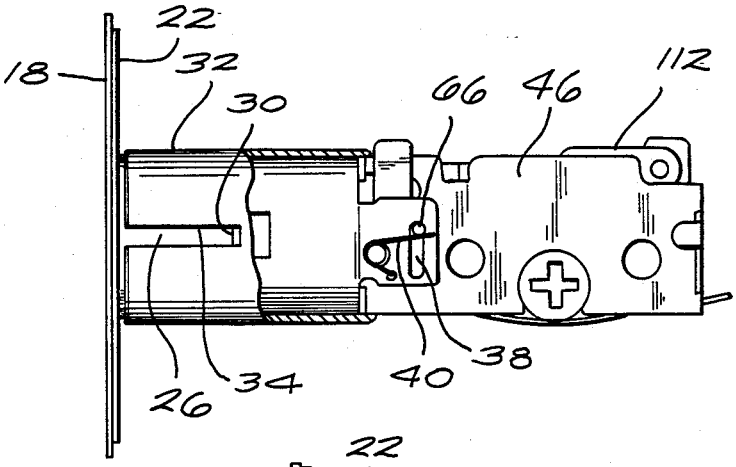
FIG. 6
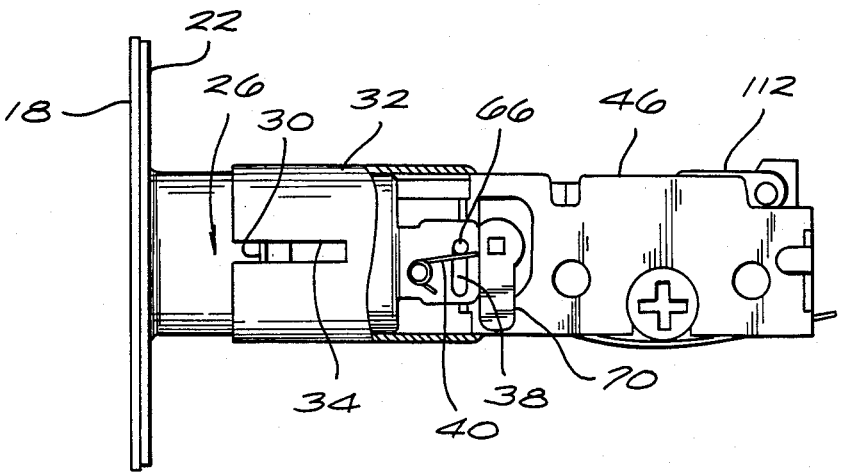
FIG. 7

ADJUSTABLE DEADLATCH

BACKGROUND OF THE INVENTION

1. Field of the Invention

The present invention relates to an adjustable deadlatch. Specifically, the invention relates to a deadlatch which is adjustable between a 2⅜" and a 2¾" backset.

2. Description of the Prior Art Entry doors are typically made to accept deadlatch locks having backsets of either one of two sizes. The normal wooden household door typically uses a deadlatch lock having a backset of 2⅜". Heavy duty metal doors which may be used for commercial or industrial purposes, or may be used for residential purposes, typically has the deadlatch having a backset of 2¾". These metal doors are normally sold with a premade opening for a 2¾" backset for the latch.

In the past, separate deadlatches were used depending upon the particular backset. Specifically, if the door requires a deadlatch having a 2⅜" backset, a deadlatch having this dimension was used with the lock. On the other hand, if the door required a deadlatch with a 2¾" backset, this size deadlatch was provided even though the remaining portions of a lockset might be identical to lockset used with the 2⅜" backset latch. In other words, the only difference between the locks for use with either the 2¾" or 2⅜" backsets was the deadlatch itself.

It has, therefore, been considered desirable to provide for an adjustable deadlatch that can be used with either a 2⅜" or 2¾" backset. This would eliminate the cost of manufacturing two separate deadlatches and would also eliminate the necessity of stocking a double inventory for complete locksets or for deadlatches. An adjustable deadlatch could, therefore, greatly simplify the inventory requirement and thereby reduce the costs of stocking this double inventory.

Unfortunately, a number of the adjustable deadlatches provided by the prior art have been complicated in structure and cumbersome in operation. For example, one such structure includes a number of arm members which must be pivoted out of the way such as a pin member extending outwardly from the deadlatch. The pin member is then pushed to translate a portion of the latch structure between the 2¾" and 2⅜" backset positions. The arm members must then be pivoted back to lock the deadlatch in position. Other prior art devices include removable pieces which must be extracted and repositioned or removed completely and all of these prior art devices do not provide for a simple reliable and easily operated adjustable deadlatch.

In order to overcome some of the described difficulties, an approved adjustable deadlatch is shown in U.S. Pat. No. 4,759,576 issued July 26, 1988 which provides for an adjustable deadlatch which is simpler in structure, but which requires a three step procedure in order to provide for the adjustment between the backset positions. Specifically, in U.S. Pat. No. 4,759,576, the backset adjustment from a first position to a second position is provided by a first step of rotating cylindrical members in a first direction to release a detent. In a second step the cylindrical members are moved logitudinally relative to each other to adjust the backset position from the first position to the second position. The final step is a rotation the cylindrical members in a second direction opposite to the first direction to lock the deadlatch in the second backset position. The present invention provides for a simpler adjustment structure than that shown in U.S. Pat. No. 4,759,576.

SUMMARY OF THE INVENTION

The present invention relates to an adjustable deadlatch which includes a positive and simple structure for adjusting the deadlatch between the 2⅜" and 2¾" backset positions. A first part of the adjustment is provided by an interior structure having one rotary member forming one cam. The one cam supports one pin member which is permanently engaged in one vertical slot. The one slot is actually formed in a portion of the deadbolt and the one pin is received in the first vertical slot. The one rotary camming member which supports the one pin, is mounted on an actuating member which interconnects the deadbolt with the remaining operating structure of the lockset.

The one vertical slot receives the one pin and as the one rotary member is turned, the pin transverses the slot from one end of the slot to the other and then back again to adjust the deadlatch in between the two backset positions. In order to control the rotary movement of the one rotary camming member, and thereby also the movement of the one pin in the one slot between the different backset positions, the present invention also includes another rotary member forming an actuator having two lock positions. When in one lock position, the deadlatch is in one of the backset positions and in the other lock position, the pin is in the other of the backset positions.

Specifically, the other rotary member has an outwardly extending actuating arm which may be used manually to rotate the other rotary member from the first to the second lock positions. The other rotary member also includes another pin member which is received in another vertical slot. The other pin member and slot operates in a similar manner to the one pin member and slot in that the other pin member is received in the other vertical slot to also form a camming structure. Specifically, the other rotary member including the other pin member is mounted for rotation on an extension from a first cylindrical member, whereas the other vertical slot is mounted on an extension from a second cylindrical member. The two cylindrical members are received telescopically one within the other and with a projection from one cylindrical member received within a longitudinal slot in the other cylindrical member. The projection and the longitudinal slot provides for a guide during longitudinal movement between the cylindrical members.

The adjustment between the backset positions is provided by rotating the other rotatable member 180° using the actuating arm. This rotation provides for a longitudinal movement between the two cylindrical members to the two backset positions. There is an interconnection between the other rotatable member and the one rotatable member so that the two rotatable members rotate together. Therefore, at the same time longitudinal movement is provided between the two cylindrical members, a similar longitudinal movement is provided between the deadbolt and the actuating member. In this way a single rotation of the actuating arm extending from the second rotating member provides for a double movement to produce the adjustment from one backset position to the other.

BRIEF DESCRIPTION OF THE DRAWINGS

A clearer understanding of the present invention will be had with reference to the following description and drawings wherein.

FIG. 1 illustrates an entry door having a first backset position for a deadlatch;

FIG. 2 illustrates an entry door having a second backset position for a deadlatch;

FIG. 3 is a perspective view of an adjustable deadlatch constructed in accordance with the teachings of the present invention which deadlatch may be used with either of the entry doors shown in FIGS. 1 or 2;

FIG. 5 is a cross sectional view of a deadlatch taken along lines 5—5 of FIG. 3;

FIG. 6 is a first side view of the deadlatch, partially broken away, showing the deadlatch in a first backset position;

FIG. 7 is the first side view of the deadlatch, partially broken away, showing the deadlatch in a second backset position;

DESCRIPTION OF THE PREFERRED EMBODIMENT

Figure 4:
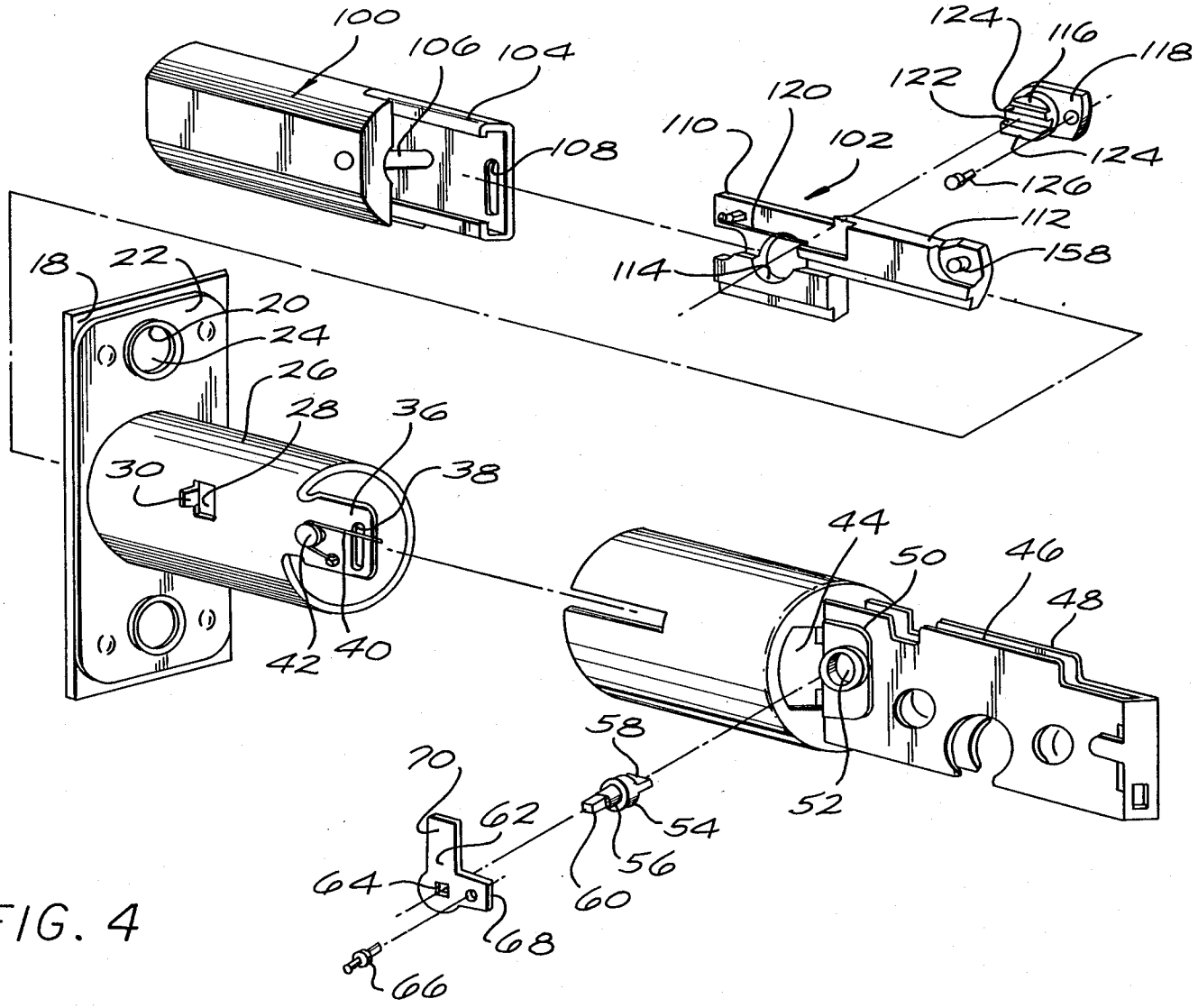
FIG. 4 is an exploded view of the deadlatch of FIG. 3.

As shown in FIGS. 1 and 2, entry doors 10 and 12 have different backsets positions. It is to be appreciated that the term "entry doors" is used to indicate a door leading from the outside to the inside of a building. This is the type of door that normally would use a deadlatch type of latchbolt. However, it is to be appreciated that the invention may be used with any type of door whether exterior or interior.

As shown in FIGS. 1 and 2, the backset represented by arrow 14 in FIG. 1 and arrow 16 in FIG. 2, have different distances. This is because heavier metal doors such as shown in FIG. 1, typically have a backset of 2¾". On the otherhand, wooden doors such as the door 12 shown in FIG. 2, typically have a backset of 2⅜". In order to accommodate the different backsets, either separate deadlatches must be used with locksets when the lockset is to be installed on doors with different backsets, or an adjustable deadlatch must be used so that the backsets can accommodate doors with different backsets.

FIGS. 3–11 illustrate a specific embodiment of an adjustable deadlatch constructed in accordance with the teachings of the present invention which deadlatch may be used with a lockset to accommodate the two different backset positions shown in FIGS. 1 and 2. These two different backset distances are respectively 2¾" for the backset position for the door in FIG. 1 and 2⅜" for the door in FIG. 2. The adjustable deadlatch includes a face plate 18 which has openings 20 for receiving screws to lock the deadlatch to the edge of the door.

Attached to the faceplate 18 is a backplate 22 which is attached to the front plate 18 by integral rivets 24. Specifically, the rivets are formed as an extension of the material around the openings 20. The rivets pass through complimentary openings in the backplate 22 and are riveted over to lock the frontplate and backplate together. The frontplate portion is also shown in dotted lines to indicate the difference in the two relative positions between the two different backsets.

Extending from the backplate 22 is a cylindrical member 26. The cylindrical member includes an opening 28 from which is formed a bent projecting portion 30. The projecting portion 30 is used to provide for a longitudinal guide between the cylindrical member 26 and a further cylindrical member. Specifically, the cylindrical member 26 fits within a complimentary cylindrical member 32. The cylindrical member 32 includes a longitudinal slot 34 which receives the projection 30 so that the two cylindrical members 26 and 32 may be guided longitudinally relative to each other without any rotary motion.

Extending from the back of the cylindrical member 26 is an arm portion 36 which includes a vertical slot 38. A spring member 40 is positioned around a post 42 to have a straight spring section extending across the vertical slot 38. The arm portion 36 is bent inward so that the arm portion can be received within the cylindrical member 32 and pass out through an opening 44 at the back end of the cylindrical member 32.

Extending back from the back end of the cylindrical member 32, are a pair of support arms 46 and 48. Mounted on the outside of the support arm 46 is a bearing block 50 which is positioned adjacent the opening 44. The bearing block 50 includes a bearing opening 52 and located for rotation within the bearing opening 52 is a rotary member 54. The rotary member 54 includes a bearing surface 56 which is received within the opening 52 and with an inner portion including a head member 58 formin a blade member. The rotary member 54 also includes a square end portion 60.

A rotary actuator 62 includes a square opening 64 to receive the square end portion 60 and with the rotary actuator 62 riveted onto the end of the rotary member 54 to capture the rotary member 54 within the bearing support 50. A pin member 66 is mounted at the end of an extending portion 68 of the rotary actuator 62 and with the pin member 66 fitting within the vertical slot 38. The rotary actuator 62 includes an actuating arm 70 which is used to actuate the adjustment of the adjustable backlatch between the two backset positions.

Located within the cylindrical members 26 and 32 and the support arms 46 and 48 is a deadbolt 100 and an actuating member 102. The deadbolt 100 includes a longitudinally extending U-shaped portion 104 mounted into slots at the back of the deadbolt and held to the deadbolt through the use of a pin member 106 to form an integral structure with the deadbolt. At the back end of the U-shaped portion 104, which forms a longitudinal opening, is a vertical slot 108.

The actuating member includes a front portion 110 for sliding with in the longitudinal U-shaped portion 104 and a back portion 112. The front portion includes an opening 114 which is used to receive a round portion 116 of a rotary member 118. The front portion 110 also includes a spring member 120. When the rotary member 118 is positioned against the back face of the front portion 110 of the actuating member 102, the round portion 116 is received within the opening 114. Extending from the round portion 116 is a slotted section 122 having flat outside surfaces 124 and with the spring member 120 lying against one or the other of the flat surfaces 124 to provide for locking positions for the rotary member 118.

The slot 122 is complimentary to the blade portion 58 of the rotary member 54. Therefore, after assembly, a rotation of the rotary member 62, using the actuating arm 70, provides not only for rotation of the rotary member 54, but also provides for rotation of the rotary member 118. The rotary member 118 also includes a pin member 126 which pin member is received within the vertical slot 108 of the portion U-shaped 104 extending from the deadbolt 100.

As shown in FIGS. 6 and 7, the adjustable deadlatch is illustrated in the two backset positions. In the 2⅜" backset position, the actuating arm 70 is in the up position. In order to adjust the deadlatch to the 2¾" backset position, the actuating arm 70 is rotated clockwise 180° to the position shown in FIG. 7 with the arm 70 in the down position. During rotation, the pin 66 rides in the vertical slot 38 against the spring bias provided by the spring member 40. The pin 66 as it rides in the vertical position also produces longitudinal movement between the two cylindrical members 26 and 32 and with this longitudinal movement guided by the projecting portion 30 riding in the guide slot 34. The movement between the cylindrical members can therefore, only be in a longitudinal direction.

At the same time the cylindrical members 26 and 30 are longitudinally moved between the two backset position, a simultaneous movement occurs between actuating member 102 and the deadbolt 100. The simultaneous movement occurs because of the interaction between the blade portion 58 of the one rotary member 54 and the slot 122 of the rotary member 118.

Figure 9:
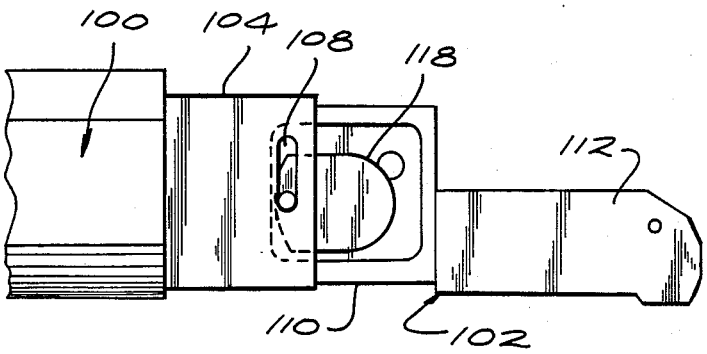
FIG. 9 is a second side view showing in detail the actuating member relative to the deadlatch with the deadlatch in the adjustable position shown in FIGS. 7 and 8.
Figure 10:
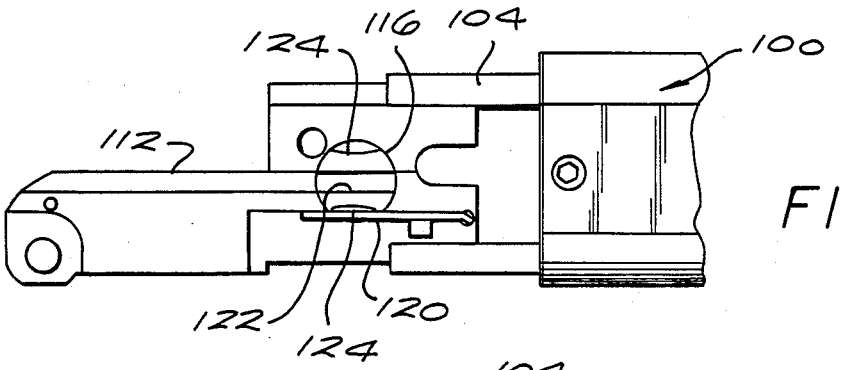
FIG. 10 is the first side view of the structure shown in FIG. 9.
Figure 11:
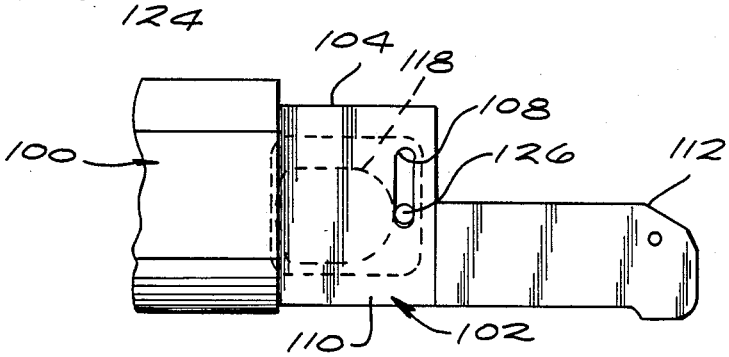
FIG. 11 is the second side view similar to FIG. 9, but with the deadlatch in the adjustable position shown in FIG. 6.

The two different backset positions for the interior structure of the adjustable deadlatch is shown in FIGS. 9 and 11. Specifically, in FIG. 9 the backset position corresponds to that shown in FIG. 7 and in FIG. 11, the backset position corresponds to that shown in FIG. 6. FIG. 10 shows the reverse side of the structure shown in FIGS. 9 and 11 and it can be seen that as the rotary portion 116 is rotated due to the action of blade 58 in the slot 122, the pin 126 shown in FIGS. 9 and 11 moves within the vertical slot 108. This produces a camming action similar to that produced between the pin 66 and the slot 38 so that the relative position between the actuating member 102 and the deadbolt 100 is adjusted to corresponding to the backset positions. The spring member 120 acting against the flat surfaces 124 provide for two locking positions between the actuating member 102 and the deadbolt 100. The pin 126 actually moves from one end to the other of the slot 108 and then back again for each adjustment between one backset position and the other.

Figure 8:
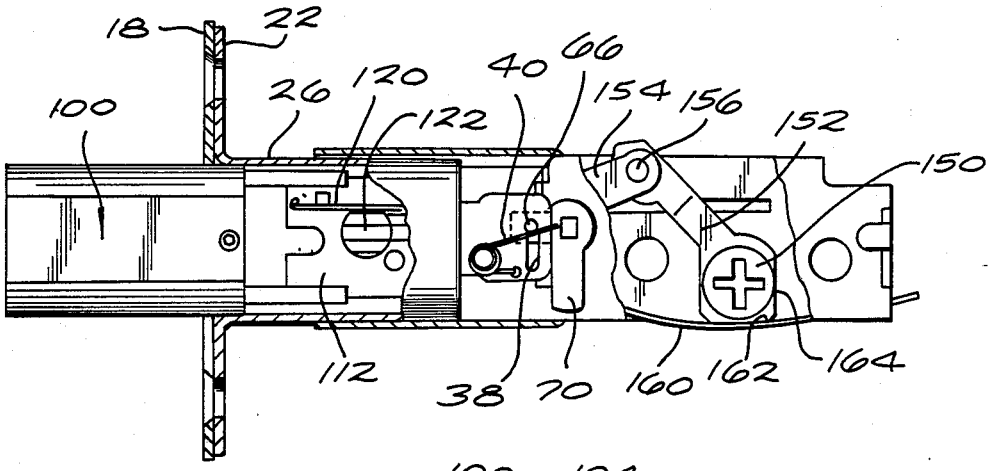
FIG. 8 is the first side view of the deadlatch in the bakset position shown in FIG. 7 and showing the deadbolt actuated.

FIG. 8 also illustrates the remaining structure of the deadlatch which is of a standard type. Specifically, a rotary member 150 operates in conjunction with a standard keyway. An arm 152 extends from the rotary member 150. A link member 154 interconnects the arm 152 and the back portion 112 of the actuating member 102. Specifically, the link 154 is pinned at both ends and with the pin connection between the link and the actuating arm 152 designated as pivot 156 and with the interconnection between the link 154 and the back end 112 of the actuator 102 designated as pivot position 158.

A spring member 160 is situated across the bottom of the deadlatch and provides for locking of the deadlatch against flat surfaces 162 or 164. The deadbolt, therefore, is in the extended position shown in FIG. 8 with the spring locked against the surface 162 or would be in the retracted position shown in FIG. 3 with the spring locked against the surface 164. In either situation, the deadlatch operates exactly the same whether the backset position is the 2⅜" or the 2¾" positions.

The present invention, therefore, provides for a simple adjustment between two backset positions by merely providing a rotational movement of an actuating arm from an up position to a down position by merely rotating the actuating arm 180°. As the actuating arm is rotated, two rotatable members also turn and with each rotatable member including a pin member which is situated in a corresponding vertical slot. As the rotatable members rotatate, the pin members ride in the vertical slots and provide for camming action to change the longitudinal position between a pair of cylindrical members and to change the longitudinal position between the deadbolt itself and the actuating member. The adjustable deadlatch of the present invention may therefore, be rapidly adjusted between the two backset positions.

Although the invention has been described with reference to a particular embodiment, it is to be appreciated that the various adaptations and modifications may be made and the invention is only to be limited by the apended claims.

I claim:

1. An adjustable deadlatch for a lockset for adjusting to either of two backset positions for the lockset including, a first cylindrical member having a first particular diameter, a second cylindrical member having a second diameter larger than the first diameter and with the first and second cylindrical members located in a telescopic arrangement for allowing longitudinal telescopic adjustment between the cylindrical members, first longitudinal adjustment means interconnected between the first and second cylindrical members and including a first vertical slot and a first pin member and with the first pin member located within the first vertical slot and further including a first rotatable member for supporting the first pin member in a radial position away from the axis of rotation of the first rotatable member so that rotation of the first rotatable member provides for a camming action of the first pin member within the first vertical slot to produce longitudinal telescopic adjustment between the cylindrical members, a deadbolt located within the first cylindrical member and including a longitudinal opening in the deadbolt, an actuating member including a longitudinal portion located within the longitudinal opening in the deadbolt, second longitudinal adjusting means coupled between the deadbolt and the actuating member and including a second vertical slot and a second pin member received within the second vertical slot and with the second pin member mounted on a second rotatable member at a radial position away from the axis of rotation of the second rotatable member and with rotation of the second rotatable member providing for camming action between the second pin member and the second vertical slot to produce longitudinal movement between the actuating member and the deadbolt, and means interconnecting the first adjustment means and the second adjustment means so that rotation of either of the adjustment means provides for rotation of the other of the adjustment means for coordinating the longitudinal adjustment between the cylindrical members and between the deadbolt and the actuating member and thereby providing for an adjustment corresponding to the two backset positions.

2. The adjustable deadlatch of claim 1 additionally including a projection formed in one of the cylindrical members and a longitudinal slot formed in the other of the cylindrical members and with the projection received in the slot to guide the longitudinal telescopic adjustment between the cylindrical members to prevent any rotational movement between the cylindrical members.

3. The adjustable deadlatch of claim 2 wherein the projection is formed by a cutout in the one cylindrical member to form a right angle bent member.

4. The adjustable deadlatch of claim 1 wherein the first and second cylindrical members each include longitudinal extending arm portions which lie adjacent to each other and with the first slot formed in one of the extending arm portions and the first rotatable member mounted for rotation on the other of the extending arm portions.

5. The adjustable deadlatch of the claim 1 wherein the first rotatable member includes an actuating arm extending from the first rotatable member and with rotation of the first and second rotatable members controlled by the actuating arm.

6. The adjustable deadlatch of claim 1 wherein the longitudinal opening in the deadbolt is formed by a longitudinal extending portion extending backward from the deadbolt and forming a U-shape extension.

7. The adjustable deadlatch of the claim 6 wherein the longitudinal portion of the actuating member is located within the U-shaped extension.

8. The adjustable deadlatch of the claim 6 wherein the second rotatable member is mounted on the longitudinal portion of the actuating member and the second vertical slot is located within the U-shaped extension.

9. The adjustable deadlatch of the claim 8 wherein the longitudinal portion of the actuating member includes a circular opening and the second rotatable member is mounted through the circular opening for rotation within the longitudinal portion.

10. The adjustable deadlatch of claim 1 wherein the means interconnecting the first and second adjustment means includes a blade portion forming part of one of the first and second rotatable members and a complementary slot portion forming part of the other of the first and second rotatable members.

11. An adjustable deadlatch for a lockset for adjusting to either of two backset positions for the lockset including, first and second cylindrical members located in a telescopic arrangement for allowing longitudinal telescopic adjustment between the cylindrical members, one of the first and second cylindrical members including a first vertical slot and the other including a first pin member and with the first pin member located within the first vertical slot, a first rotatable member supporting the first pin member in a radial position away from the axis of rotation of the first rotatable member so that rotation of the first rotatable member produces longitudinal telescopic adjustment between the cylindrical members, a deadbolt located within the first cylindrical member and including a longitudinal opening in the deadbolt, an actuating member including a longitudinal portion located within the longitudinal opening in the deadbolt, one of the deadbolt and the actuating member including a second vertical slot and the other including a second pin member received within the second vertical slot, a second rotatable member supporting the second pin member at a radial position away from the axis of rotation of the second rotatable member so that rotation of the second rotatable member produces longitudinal movement between the actuating member and the deadbolt, and means interconnecting the first rotatable member and the second rotatable member for coordinating the longitudinal adjustment between the cylindrical members and between the deadbolt and the actuating members and between the deadbolt and the actuating member and thereby providing for an adjustment corresponding to the two backset positions.

12. The adjustable deadlatch of claim 11 additionally including a projection formed in one of the cylindrical members and a longitudinal slot formed in the other of the cylindrical members and with the projection received in the slot to guide the longitudinal telescopic adjustment between the cylindrical members to prevent any rotational movement between the cylindrical members.

13. The adjustable deadlatch of claim 12 wherein the projection is formed by a cutout in the one cylindrical member to form a right angle bent member.

14. The adjustable deadlatch of claim 11 wherein the first and second cylindrical members each include longitudinal extending arm portions which lie adjacent to each other and with the first slot formed in one of the extending arm portions and the first rotatable member mounted for rotation on the other of the extending arm portions.

15. The adjustable deadlatch of claim 11 wherein the first rotatable member includes an actuating arm extending from the first rotatable member and with rotation of the first and second rotatable members controlled by the actuating arm.

16. The adjustable deadlatch of claim 11 wherein the longitudinal opening in the deadbolt is formed by a longitudinal extending portion extending backward from the deadbolt and forming a U-shaped extension.

17. The adjustable deadlatch of claim 16 wherein the longitudinal portion of the actuating member is located within the U-shaped extension.

18. The adjustable deadlatch of claim 16 wherein the second rotatable member is mounted on the longitudinal portion of the actuating member and the second vertical slot is located within the U-shaped extension.

19. The adjustable deadlatch of claim 18 wherein the longitudinal portion of the actuating member includes a circular opening and the second rotatable member is mounted through the circular opening for rotation within the longitudinal portion.

20. The adjustable deadlatch of claim 11 wherein the means interconnecting the first and second rotatable members includes a blade portion forming part of one of the first and second rotatable members and a complementory slot portion forming part of the other of the first and second rotatable members.

* * * * *